US007448903B2

(12) United States Patent
Zhang

(10) Patent No.: US 7,448,903 B2
(45) Date of Patent: Nov. 11, 2008

(54) CABLE CONNECTOR

(76) Inventor: Zhejia Zhang, No. 2 Diyong Industrial District, Gaobu Town, Dongguan (CN) 523000

( * ) Notice: Subject to any disclaimer, the term of this patent is extended or adjusted under 35 U.S.C. 154(b) by 0 days.

(21) Appl. No.: 11/550,422

(22) Filed: Oct. 18, 2006

(65) Prior Publication Data

US 2007/0123106 A1 May 31, 2007

(30) Foreign Application Priority Data

Oct. 29, 2005 (CN) ..... 2005 1 0100903

(51) Int. Cl.
*H01R 12/24* (2006.01)

(52) U.S. Cl. ..... 439/497

(58) Field of Classification Search ..... 439/497, 439/610, 98

See application file for complete search history.

(56) References Cited

U.S. PATENT DOCUMENTS 6,250,936 B1 * 6/2001 Armistead et al. ..... 439/98
6,338,652 B1 * 1/2002 Ko ..... 439/579
6,685,511 B2 * 2/2004 Akama et al. ..... 439/610

* cited by examiner

*Primary Examiner*—Javaid Nasri
(74) *Attorney, Agent, or Firm*—Lowe Hauptman Ham & Berner, LLP

(57) ABSTRACT

A cable connector comprising a connection-peg, comprising a plurality of transmission terminals; a plurality of transmission channels, electrically connecting with transmission terminals and comprising signal wire in pair; a plurality of signal grounds, mounted in the place among the each transmission channels; a first conducting cover unit, binding and laying over one of the section of every transmission channel and signal grounds, wherein one of the area, defined as an uncovered areas, of the transmission channels and signal grounds between the first conducting cover unit and the transmission terminals aren't covered by the first conducting cover unit, and at least a pair of signal wires of one transmission channel wrapped each other, and a second conducting cover unit, binding and laying over the uncovered area.

7 Claims, 3 Drawing Sheets

CABLE CONNECTOR

BACKGROUND OF THE INVENTION

1. Field of the Invention

The present invention relates to a cable connector, and more particularly to a cable connector that transmits the high frequency signal of the low voltage differential signal.

2. Description of the Prior Art

When a cable transmits electric current, because of shooting and acceptance of signals having a different potential, which form a noise voltage, producing interference of electromagnetic from other circuit signals, it influences the quality of the whole circuit, that is what we called EMI, so how to resolve the interference of the electromagnetic has become a topic that we have to face.

Nowadays, because low voltage differential signaling (LVDS) is provided with the superiority of low voltage, producing more stable signal, we usually use it to reduce the EMI of equipments.

Recently, in order to satisfy the increasing frequency of signal transmission, we usually use a sort of flat cable covered by the method of aluminum foil and metallic web to transmit the signal, thereby producing a earthing return channel of low electromagnetic mutual for signal electric current, reducing the interference of the noise.

Commonly, a flat cable comprises a plurality of sets of transmission signal pairs, which are formed by two transmission signal wires with both sides of stickiness adhesive plaster binding face to face, as disclosed in the Taiwanese Patent Application No. 094106716, but during the course of manufacture, because of the encounter of each other, the match of the impedance of each signal transmission pair produces an error.

SUMMARY OF THE INVENTION

The primary object of the present invention is to provide a electric connector with a higher transmission efficiency, a more convenient manufacture method and being of more competitive and reliable comprising. A cable connector comprising a connection-peg, comprising a plurality of transmission terminals; a plurality of transmission channels, electrically connecting with the transmission terminals and comprising signal wire in pair; a plurality of signals grounds, mounted in the place among the each transmission channels; a first conducting cover unit, binding and laying over one of the section of every transmission channel and signal ground, wherein there is an uncovered area where the transmission channels and the signal grounds between the first conducting cover unit and the transmission terminals aren't covered by the first conducting cover unit, and at least a pair of signal wires of one transmission channel wrapped each other, and a second conducting cover unit, binding and laying over the uncovered area, a metallic housing mounted on the connection-peg and laying over the transmission terminals, a plurality of third conducting cover units, binding and covering each transmission channel in the first conducting cover unit.

The first conducting cover unit is a conducting adhesive plaster; the second conducting cover unit is formed by oppositely binding of two metallic webs provided with conducting adhesive layers; each signal wire is provided with an outer insulating layer; the second conducting cover unit binds and covers the area between the first conducting cover unit and the metallic housing.

The third conducting cover units conduct in the single side, and are provided with an insulating adhesive layer on the side opposite to the transmission channels.

DETAILED DESCRIPTION OF THE PREFERRED EMBODIMENTS

Figure 1:
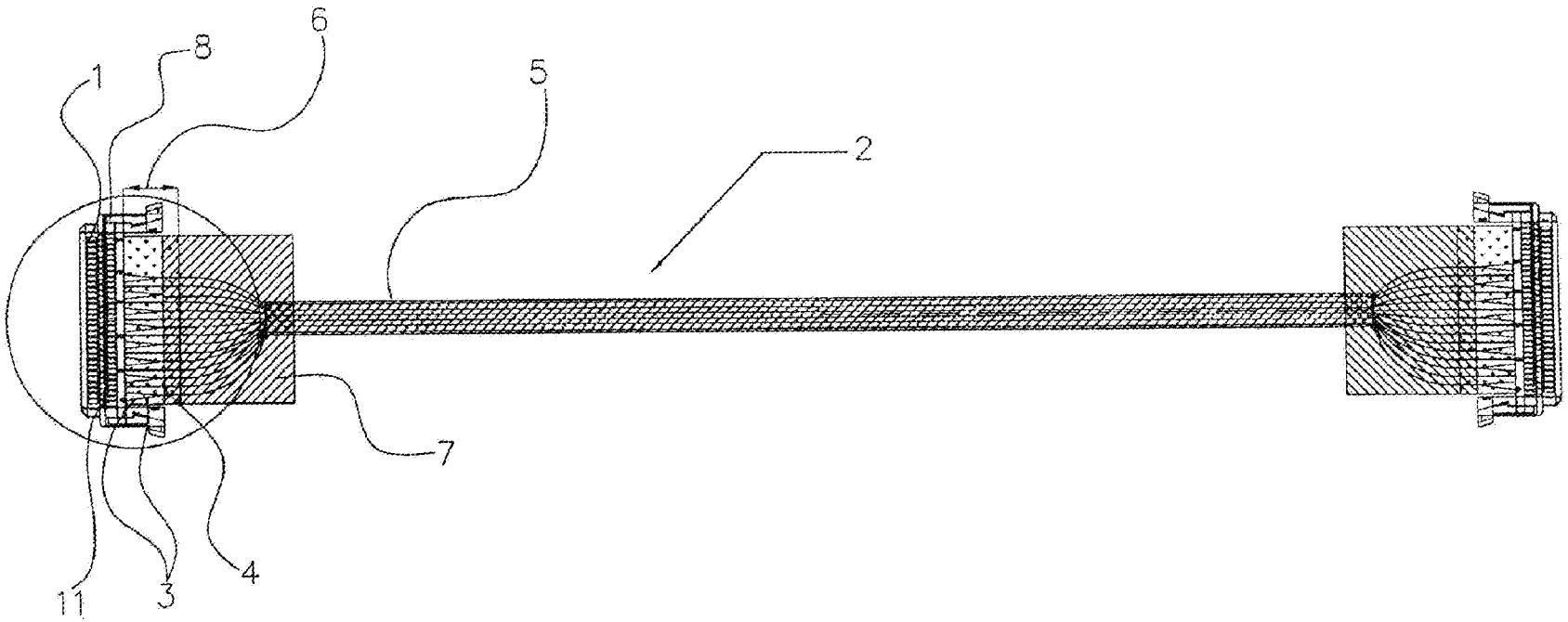
FIG. 1 is an amplified perspective view showing the present invention.

Referring to FIG. 1, the present invention comprises a connection-peg 1 which is provided with a plurality of transmission terminals 11, that is to say wherein the transmission terminals 11 are mounted in the connection-peg 1 separately, thereby electrically connecting with each transmission channel 3 and a cable body 2, and the cable body 2 comprises a plurality of transmission channels 3, a plurality of signal grounds 4 mounted in the place among the each transmission channel 3, a first conducting cover unit 5 binding and covering each transmission channel 3 and signal ground 4.

Figure 2:
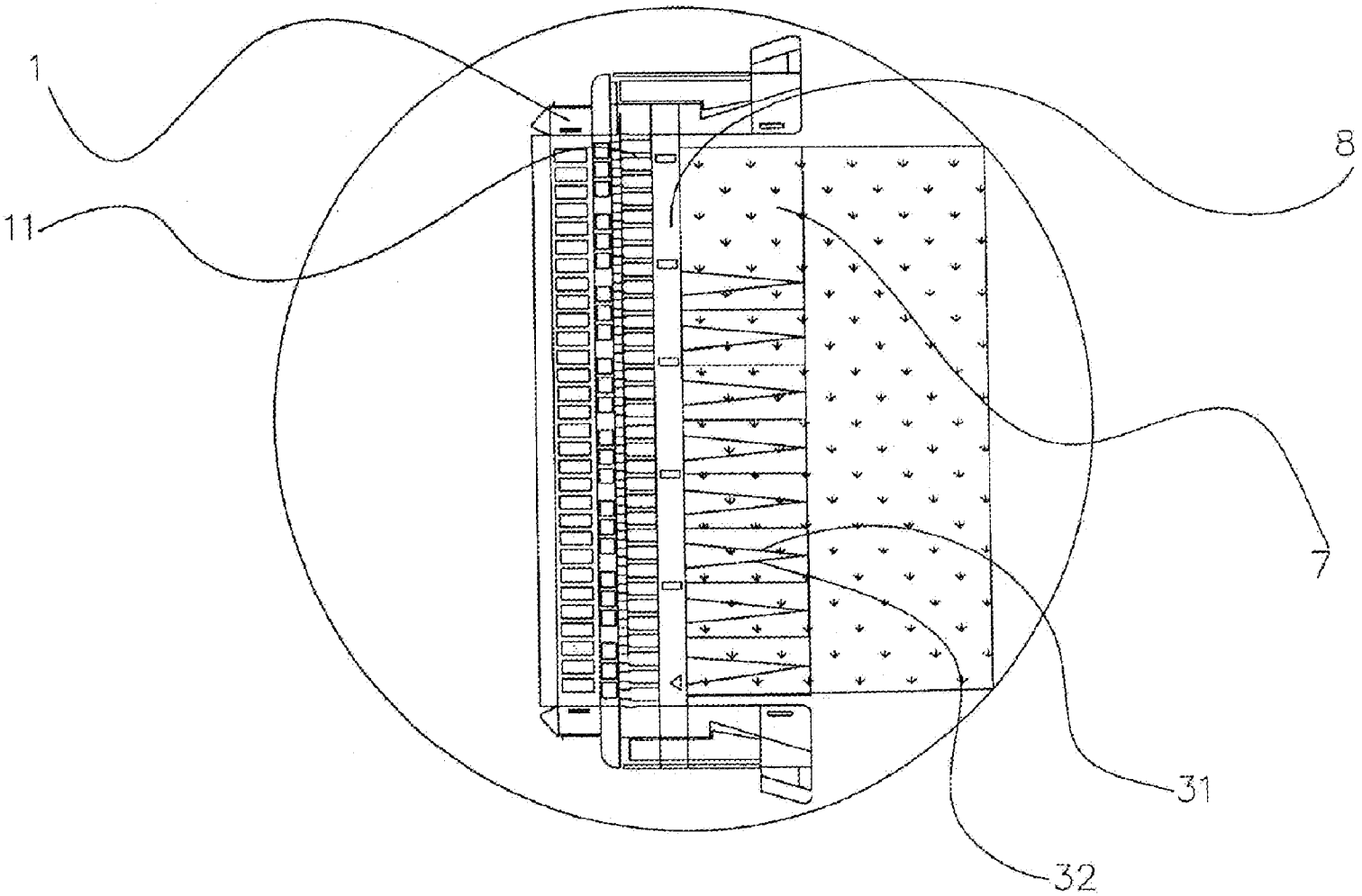
FIG. 2 is a sectional amplified plane view showing the present invention.

Referring to FIG. 2, each transmission channel 3 comprises a plurality of signal wire pairs 31, 32, providing the return path of the electric current of the circuit equipment connected by signal transmission terminals 11, forming a transmission pair. In order to avoid the errors of impedances among the transmission channels 3 produced by the interference of the encounter of each other during the course of manufacture, the first conducting cover unit 5 doesn't lay over the signal grounds 4 and transmission channels 3, i.e. there is an area, defined as an uncovered area 6, where the transmission channels 3 and the signal grounds 4 between the first conducting cover unit 5 and the transmission terminals 11 are not covered by the first conducting cover unit 5, and the uncovered area 6 is covered by a second conducting cover unit 7, after fine trimming the impedance among the signal wires 31, 32 of each transmission channel 3.

Figure 3:
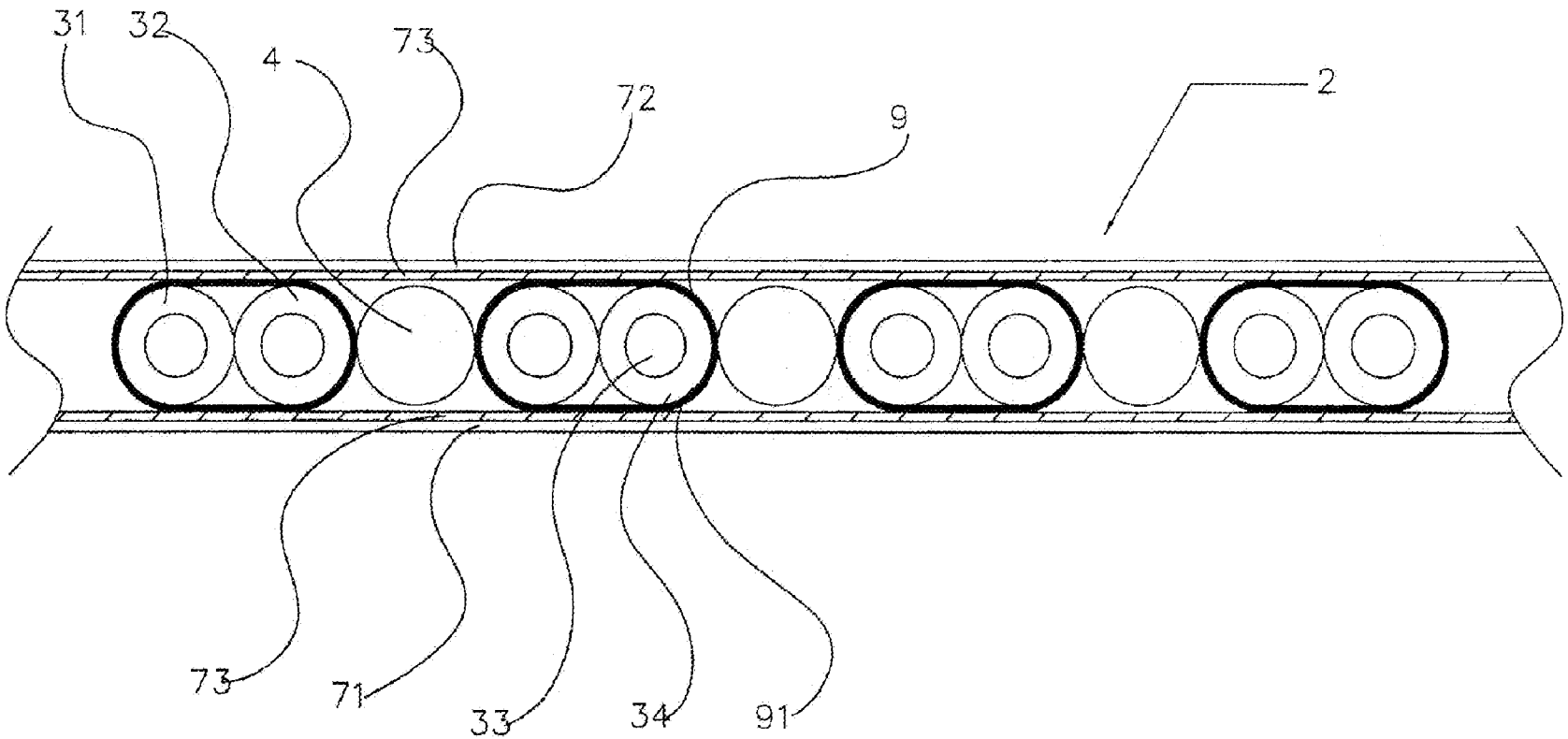
FIG. 3 is a sectional view showing the cable body of the present invention.

Referring to FIG. 3, each signal wire 31, 32, out of the conducting layer 33, opposite to the second conducting cover unit 7, has an insulating layer 34, thereby effectively separating transmission signals and voltage noises. The second conducting cover unit 7 is made of two metallic webs 71, 72, the inner layer of which is provided with conducting adhesive layer, thereby sticking and laying over insulting layer out of each signal wire 31, 32 and signal ground 4, and the signal ground 4 is bared, thereby increasing the effect of earthing.

Referring to FIGS. 2 and 3, during the course of manufacture, first of all, make the signal wires 31, 32 of transmission channels 3 and signal grounds 4 adhere to the first conducting cover unit 5. Then, when the first conducting cover unit 5 adheres to each transmission channel 3 and signal ground 4, it is leaved an uncovered area 6, making the conducting adhesive layer 73 of metallic web 71 adhere to the first conducting cover unit 5. Furthermore, wherein a plurality of the transmission channels 3 are extended by the first conducting cover unit 5, which stands on the place between two metallic webs 71, 72 in order and there is at least one signal wire pair 31, 32 of the transmission channels 3 is wrapped each other. According to the need of impedance of the signal wires 31, 32 of each transmission channel 3, fines trimming it to the best one, then make the conducting adhesive layer 73 of another metallic web 72 and the metallic web 71 bind and cover the uncovered area 6 of signal wires 31, 32 and the signal grounds 4 face to face.

Wherein the conducting layer 33 of signal wire pairs 31, 32 of the transmission channels 3 electrically connects with each transmission terminal 11 of the connection-peg 1 in order. A metallic housing 8 mounts on the connection-peg 1 and adheres to the uncovered area 6, covering the transmission terminals 11 and the conducting layer 33 of signal wires 31, 32. Because of the second conducting cover unit 7 oppositely adhering to the transmission channels 3 and the signal grounds 4 in the uncovered area 6 between the first conducting cover unit 5 and the metallic housing 8, don't produce interference aroused by trimming among the each transmission channel 3, which ensure each impedance of the transmission channel in the cable body is matched.

Out of the insulating layer 34 of the signal wires 31, 32 of each transmission channel 3 among the first conducting cover unit 5 is covered by a third conducting cover unit 9 (FIG. 3), wherein the third conducting cover unit 9 is an aluminum foil mylar or other metallic foil with a single conducting side. Furthermore, there is an insulating adhesive layer 91 on the non-conductive side of the third conducting cover unit 9, thereby adhering and positing the insulating layer 34 of the signal wires 31, 32. For example: the insulating layer is made of heating thermoplastic adhesive materials mounted on the non-conductive side of the aluminum foil mylar, forming the aluminum foil provided with adhesive layer, then mounts it in the inner side, tightly constraining the signal wire via making use of the method of spirally wrapping and covering, melting it after that immediately, binding the insulting layers of signal wires and the heating thermoplastic adhesive materials to a wholly one.

It is of course to be understood that the embodiments described herein are merely illustrative of the principles of the invention and that a wide variety of modifications thereto may be effected by persons skilled in the art without departing from the spirit and scope of the invention as set forth in the following claims.

The following is a list of abbreviations used in the text of the specification and in the drawings: 1 -connection-peg; 2 -cable body; 3 -transmission channel; 4 signal ground; 5 -the first conducting cover unit; 6 -uncovered area; 7 -the second conducting cover unit; 8 -metallic housing; 9 -the third conducting cover unit; 11 transmission terminal; 31, 32 -signal wire; 33 -conducting layer; 34 -insulating layer; 71, 72 -metallic webs; 73 -conducting adhesive layer; 91 -insulating adhesive layer.

What is claimed is:

1. A cable connector comprising:

a connection-peg, comprising a plurality of transmission terminals;

a plurality of transmission channels electrically connecting with said transmission terminals and comprising pairs of signal wires;

a plurality of signal grounds mounted between said transmission channels;

a first conducting cover unit enclosing said transmission channels and said signal grounds, and an uncovered area located between said first conducting cover unit and said transmission terminals, wherein said transmission channels and said signal grounds among said uncovered area are not covered by said first conducting cover unit, and a second conducting cover unit disposed on said uncovered area for enclosing said transmission channels and said signal grounds characterized in that said first conducting cover unit is a conductive adhesive plaster, and said second conducting cover unit is formed by joining two opposite metallic webs provided with conductive adhesive layers.

2. The cable connector according to claim 1 wherein each signal wire is provided with an outer insulating layer.

3. The cable connector according to claim 1 wherein the signal ground is a bare wire.

4. The cable connector according to claim 1 comprising further a metallic housing, wherein said second conducting cover unit overlaps with said first conducting cover unit and said metallic housing.

5. A cable connector comprising:

a connection-peg comprising a plurality of transmission terminals;

a plurality of transmission channels electrically connecting with said transmission terminals and comprising pairs of signal wires;

a metallic housing mounted on the connection-peg for enclosing said transmission terminals;

a plurality of signal grounds mounded between said transmission channels;

a first conducting cover unit enclosing said transmission channels and said signal grounds, and an uncovered area located between said first conducting cover unit and said transmission terminals, wherein said transmission channels and said signal grounds among said uncovered area are not covered by said first conducting cover unit, and a second conducting cover unit disposed on said uncovered area for enclosing said transmission channels and said signal grounds, characterized in that said first conducting cover unit is a conducting adhesive plaster, and said second conducting cover unit is formed by joining two opposite metallic webs provided with conducting adhesive layers.

6. A cable connector comprising:

a connection-peg, comprising a plurality of transmission terminals;

a plurality of transmission channels electrically connecting with said transmission terminals and comprising pairs of signal wires;

a plurality of signal grounds mounted between said transmission channels;

a first conducting cover unit enclosing said transmission channels and said signal grounds, and an uncovered area located between said first conducting cover unit and said transmission terminals, wherein said transmission channels and said signal grounds among said uncovered area are not covered by said first conducting cover units;

a second conducting cover unit disposed on said uncovered area for enclosing said transmission channels and said signal grounds characterized in that said first conducting cover unit is a conductive adhesive plaster, and said second conducting cover unit is formed by joining two opposite metallic webs provided with conductive adhesive layers; and said cable connector further comprising a plurality of third conducting cover units wherein said third conducting cover units bind and cover each transmission channel with first said conducting cover unit and wherein said third conducting cover unit conducts on a single side and is provided with an insulating adhesive layer on the opposite side of the transmission channels.

7. The cable connector according to claim 6 wherein said third conducting cover units are made of aluminum foil mylar.

* * * * *